US006919868B2

(12) United States Patent
Tam

(10) Patent No.: US 6,919,868 B2
(45) Date of Patent: Jul. 19, 2005

(54) CIRCUIT, DRIVER CIRCUIT, ELECTRO-OPTICAL DEVICE, ORGANIC ELECTROLUMINESCENT DISPLAY DEVICE ELECTRONIC APPARATUS, METHOD OF CONTROLLING THE CURRENT SUPPLY TO A CURRENT DRIVEN ELEMENT, AND METHOD FOR DRIVING A CIRCUIT

(75) Inventor: Simon Tam, Cambridge (GB)

(73) Assignee: Seiko Epson Corporation, Tokyo (JP)

( * ) Notice: Subject to any disclaimer, the term of this patent is extended or adjusted under 35 U.S.C. 154(b) by 235 days.

(21) Appl. No.: 09/899,916

(22) Filed: Jul. 9, 2001

(65) Prior Publication Data

US 2002/0021293 A1 Feb. 21, 2002

(30) Foreign Application Priority Data

Jul. 7, 2000 (GB) ..... 0016815

(51) Int. Cl.[7] ..... G09G 3/30

(52) U.S. Cl. ..... 345/76; 345/82; 345/204; 315/169.3

(58) Field of Search ..... 345/76–80, 82–84, 345/44–46, 204; 315/169.1–169.3, 169.4

(56) References Cited

U.S. PATENT DOCUMENTS

| | | | | |
|---|---|---|---|---|
| 3,443,151 A | | 5/1969 | Myers et al. | |
| 5,525,923 A | | 6/1996 | Bialas, Jr. et al. | |
| 5,714,968 A | * | 2/1998 | Ikeda | 345/77 |
| 5,903,246 A | | 5/1999 | Dingwall | |
| 5,952,789 A | | 9/1999 | Stewart et al. | |
| 6,011,532 A | | 1/2000 | Yanai et al. | |
| 6,369,788 B1 | * | 4/2002 | Yamazaki et al. | 345/92 |
| 6,433,488 B1 | * | 8/2002 | Bu | 315/169.3 |

FOREIGN PATENT DOCUMENTS

| | | |
|---|---|---|
| EP | 0 597 226 A1 | 5/1994 |
| EP | 0 766 221 A1 | 4/1997 |
| EP | 0 895 219 A1 | 2/1999 |
| EP | 0 917 127 A1 | 5/1999 |
| WO | WO 99/65011 | 12/1999 |
| WO | WO 01/26087 A1 | 4/2001 |

OTHER PUBLICATIONS

Dawson, R.M.A., et al., "The Impact of the Transient Response of Organic Light Emitting Diodes on the Design of Active Matrix OLED Displays", *IEEE*, 1998, IEDM 98, pp. 895–878.

* cited by examiner

*Primary Examiner*—Regina Liang
(74) *Attorney, Agent, or Firm*—Oliff & Berridge, PLC

(57) ABSTRACT

A driver circuit comprises a p-channel transistor and an n-channel transistor connected as a complementary pair of transistors to provide analog control of the drive current for a current driven element, preferably an organic electroluminescent element (OEL element). The transistors, being of opposite channel, compensate, for any variation in threshold voltage $\Delta V_T$ and therefore provide a drive current to the OEL element which is relatively independent of $\Delta V_T$. The complementary pair of transistors can be applied to either voltage driving or current driving pixel driver circuits.

41 Claims, 11 Drawing Sheets

Fig. 12
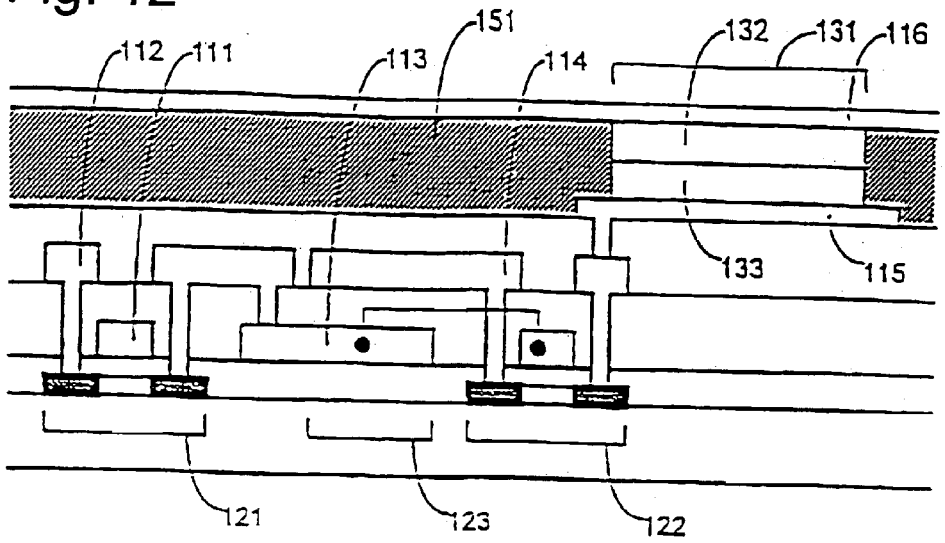
Fig. 13
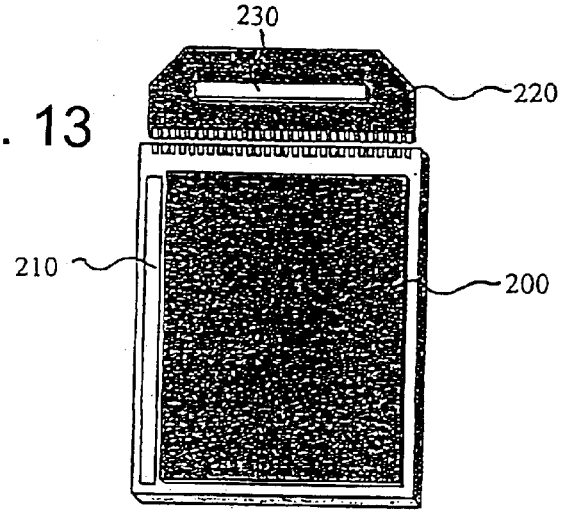
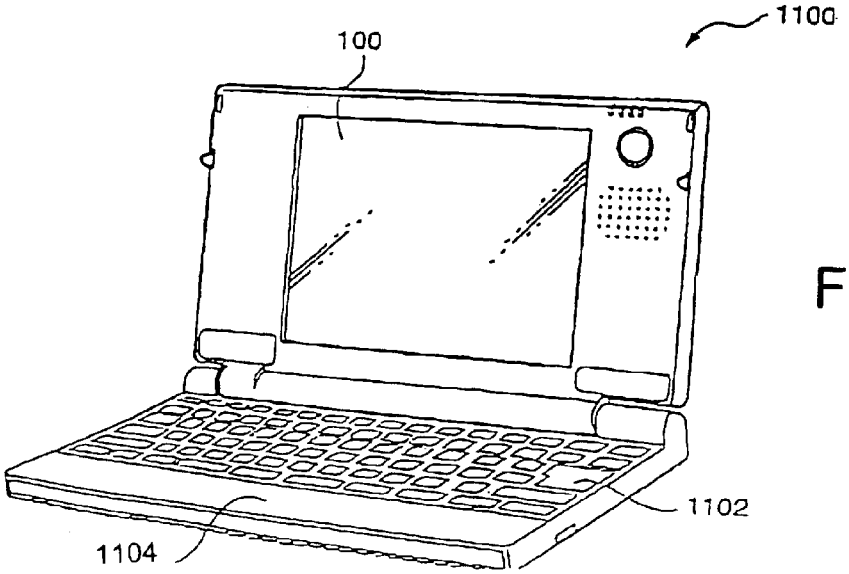
Fig. 14

CIRCUIT, DRIVER CIRCUIT, ELECTRO-OPTICAL DEVICE, ORGANIC ELECTROLUMINESCENT DISPLAY DEVICE ELECTRONIC APPARATUS, METHOD OF CONTROLLING THE CURRENT SUPPLY TO A CURRENT DRIVEN ELEMENT, AND METHOD FOR DRIVING A CIRCUIT

The present invention relates to a driver circuit. One particular application of such a driver circuit is for driving an organic electroluminescent element.

An organic electroluminescent (OEL) element OEL elementcomprises a light emitting material layer sandwiched between an anode layer and a cathode layer. Electrically, this element operates like a diode. Optically, it emits light when forward biased and the intensity of the emission increases with the forward bias current. It is possible to construct a display panel with a matrix of OEL elements fabricated on a transparent substrate and with at least one of the electrode layers being transparent. It is also possible to integrate the driving circuit on the same panel by using low temperature polysilicon thin film transistor (TFT) technology.

In a basic analog driving scheme for an active matrix OEL display, a minimum of two transistors are required per pixel. Such a driving scheme is illustrated in FIG. 1. Transistor $T_1$ is provided to address the pixel and transistor $T_2$ is provided to convert a data voltage signal $V_{Data}$ into current which drives the OEL element at a designated brightness. The data signal is stored by a storage capacitor $C_{storage}$ when the pixel is not addressed. Although p-channel TFTs are shown in the figure, the same principle can also be applied for a circuit utilising n-channel TFTs.

There are problems associated with TFT analog circuit and OEL elements do not act like perfect diodes. The light emitting material does, however, have relatively uniform characteristics. Due to the nature of the TFT fabrication technique, spatial variation of the TFT characteristics exists over the extent of the display panel. One of the most important considerations in a TFT analog circuit is the variation of threshold voltage, $\Delta V_T$, from device to device. The effect of such variation in an OEL display, exacerbated by the non perfect diode behaviour, is the non-uniform pixel brightness over the display area of the panel, which seriously affects the image quality. Therefore, a built-in circuit for compensating a dispersion of transistor characteristics is required.

A circuit shown in FIG. 2 is proposed as one of built-in for compensating a variation of transistor characteristics. In this circuit, transistor $T_1$ is provided for addressing the pixel. Transistor $T_2$ operates as an analog current control to provide the driving current to the OEL element. Transistor $T_3$ connects between the drain and gate of transistor $T_2$ and toggles transistor $T_2$ to act either as a diode or in a saturation mode. Transistor $T_4$ acts as a switch in response to an applied waveform $V_{GP}$. Either Transistor $T_1$ or transistor $T_4$ can be ON at any one time. Initially, at time $t_0$ shown in the timing diagram of FIG. 2, transistors $T_1$ and $T_3$ are OFF, and transistor $T_4$ is ON. When transistor $T_4$ is OFF, transistors $T_1$ and $T_3$ are ON, and a current $I_{DAT}$ of known value is allowed to flow into the OEL element, through transistor $T_2$. This is the programming stage because the threshold voltage of transistor $T_2$ is measured with transistor $T_3$ turned ON which shorts the drain and gate of transistor $T_2$. Hence transistor $T_2$ operates as a diode while the programming current is allowed to flow through transistors $T_1$ and $T_2$ and into the OEL element. The detected threshold voltage of transistor $T_2$ is stored by a capacitor $C_1$ connected between the gate and source terns of transistor $T_2$ when transistors $T_3$ and $T_1$ are switched OFF. Transistor $T_4$ is then turned ON by driving waveform $V_{GP}$ and the current through the OEL element is now provided by supply $V_{DD}$. If the slope of the output characteristics for transistor $T_2$ were flat, the reproduced current would be the same as the programmed current for any threshold voltage of $T_2$ detected and stored in capacitor $C_1$. However, by turning ON transistor $T_4$, the drain-source voltage of transistor $T_2$ is pulled up, so a flat output characteristic will maintain the reproduced current at the same level as the programmed current. Note that $\Delta V_{T2}$ shown in FIG. 2 is imaginary, not real. It has been used solely to represent the threshold voltage of transistor $T_2$.

A constant current is provided, in theory, during a subsequent active programming stage, which is signified by the time interval $t_2$ to $t_5$ in the timing diagram shown in FIG. 2. The reproduction stage starts at time $t_6$.

The circuit of FIG. 2 does provide an improvement over the circuit shown in FIG. 1 but variations in the threshold value of the control transistor are not fully compensated and variations in image brightness over the display area of the panel remain.

The present invention seeks to provide an improved driver circuit. In its application to OEL elements the present invention seeks to provide an improved pixel driver circuit in which variations in the threshold voltages of the pixel driver transistor can be further compensated, thereby providing a more uniform pixel brightness over the display area of the panel and, therefore, improved image quality.

According to a first aspect of the present invention there is provided a driver circuit for a current driven element, the circuit comprising an n-channel transistor and a complementary p-channel transistor connected so as to operatively control, in combination, the current supplied to the current driven element.

Beneficially, the current driven element is an electroluminescent element.

Preferably, the driver circuit also comprises respective storage capacitors for the n-channel and p-channel transistors and respective switching means connected so as to establish when operative respective paths to the n-channel and p-channel transistors for respective data voltage pulses.

Advantageously, the driver circuit may also comprise respective storage capacitors for storing a respective operating voltage of the n-channel and the p-channel transistors during a programming stage, a first switching means connected so as to establish when operative a first current path from a source of current data signals through the n-channel and p-channel transistors and the current driven element during the programming stage, and a second switching means connected to establish when operative a second current path through the n-channel and p-channel transistors and the current driven element during a reproduction stage.

In a further embodiment, the first switching means and the source of current data signals are connected so as to provide when operative a current source for the current driven element.

In an alternative embodiment, the first switching means the source of current data signals are connected so as to provide when operative a current sink for the current driven element.

According to a second aspect of the present invention there is also provided a method of controlling the supply current to a current driven element comprising providing an n-channel transistor and a p-channel transistor connected so as to operatively control, in combination, the supply current to the current driven element.

Preferably, the method further comprises providing respective storage capacitors for the n-channel and p-channel transistors and respective switching means connected so as to establish when operative respective paths to the n-channel and p-channel transistors for respective data voltage pulses thereby to establish, when operative, a voltage driver circuit for the current driven element.

Advantageously, the method may comprise providing a programing stage during which the n-channel and p-channel transistors are operated in a first mode and wherein a current path from a source of current data signals is established through the n-channel and the p-channel transistors and the current driven element and wherein a respective operating voltage of the n-channel transistor and the p-channel transistor is stored in respective storage capacitors, and a reproduction stage wherein a second mode and a second current path is established though the n-channel transistor and the p-channel transistor and the current driven element.

Beneficially, the present invention provides a method of controlling the supply current to an electroluminescent display comprising the method of the invention as described above wherein the current driven element is an electroluminescent element.

According to a third aspect of the present invention, there is also provided an organic electroluminescent display device comprising a driver circuit as claimed in any one of claims 1 to 12.

The present invention will now be described by way of further example only and with reference to the accompanying drawings in which:

FIG. 12 is a schematic sectional view of a physical implementation of an OEL element and driver according to an embodiment of the present invention;

FIG. 13 is a simplified plan view of an OEL element OEL display panel incorporating the present invention;

FIG. 14 is a schematic view of a mobile personal computer incorporating a display device having a driver according to the present invention;

Figure 15:
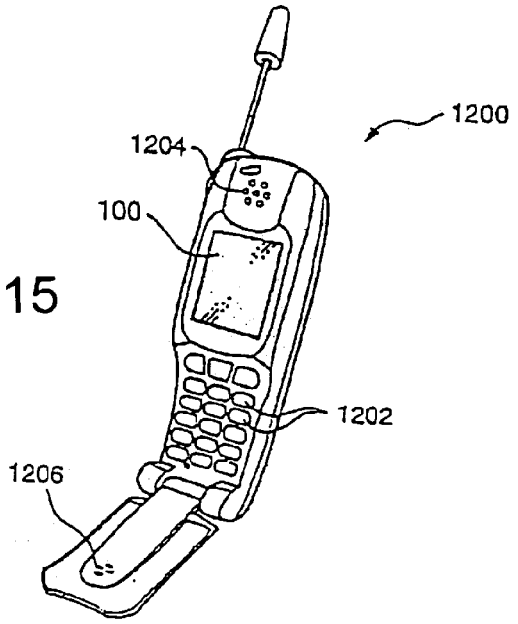
Figure 16:
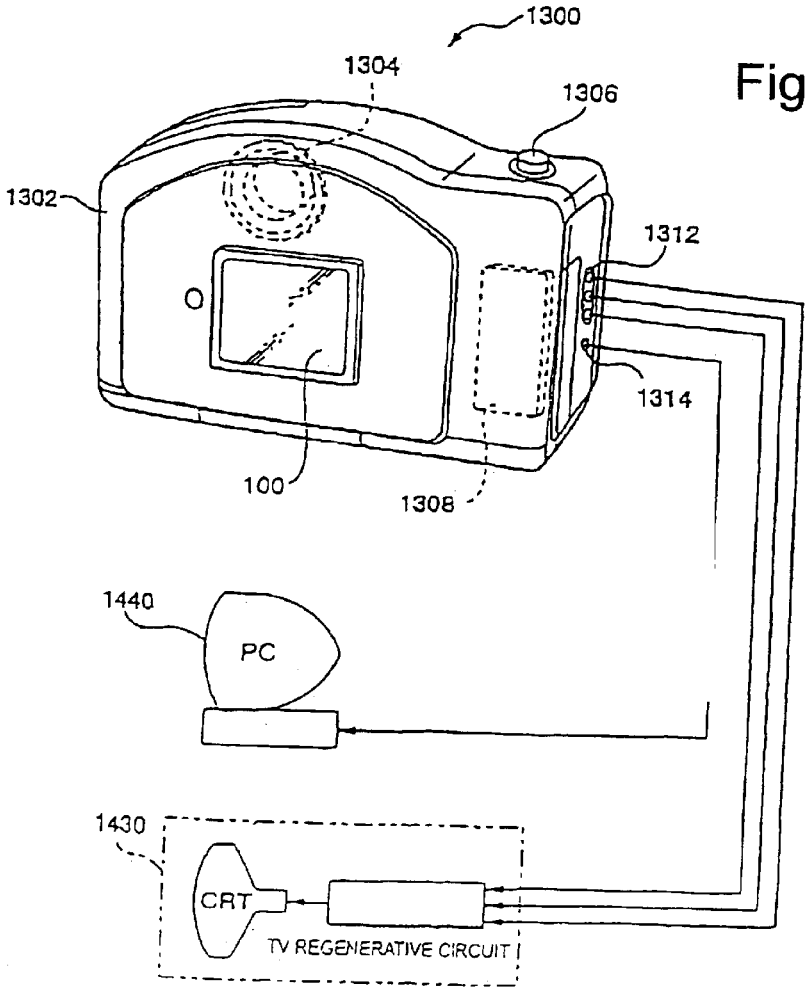
Figure 17:
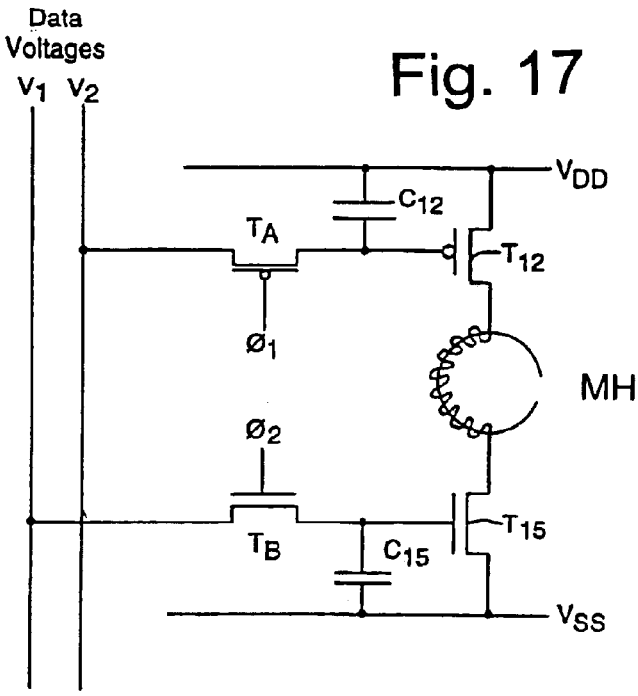
Figure 18:
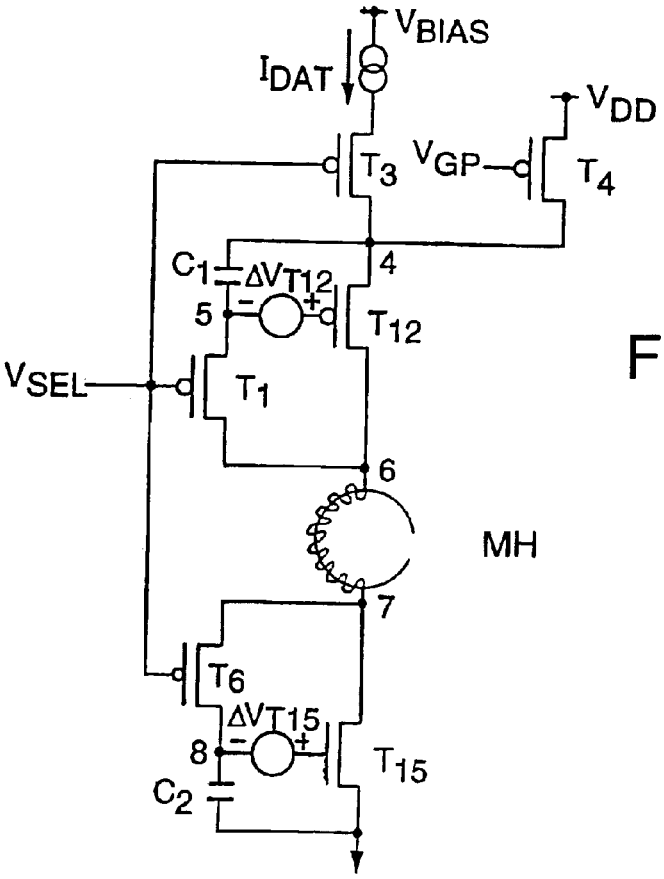
Figure 19:
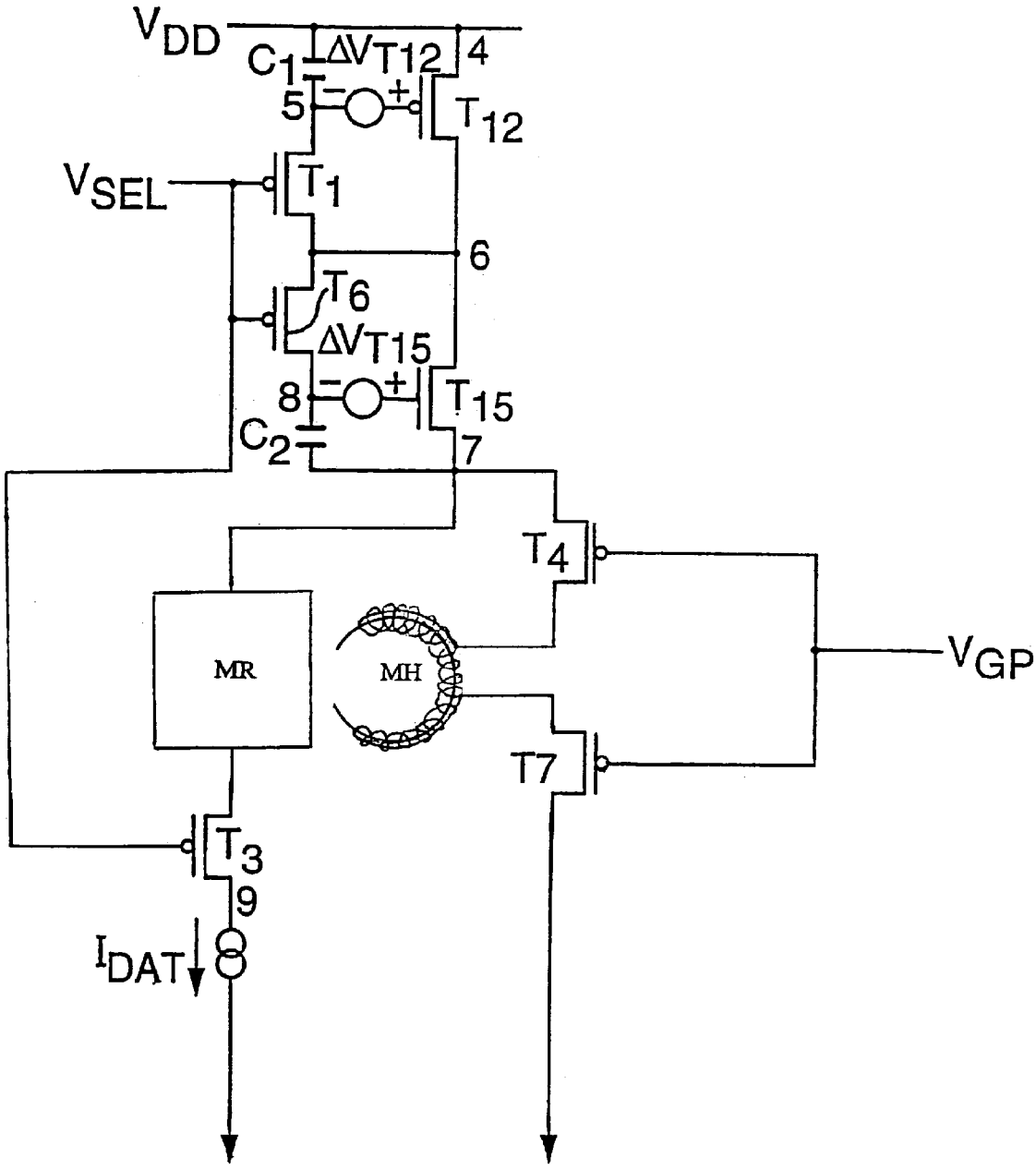

FIG. 15 is a schematic view of a mobile telephone incorporating a display device having a driver according to the present invention, FIG. 16 is a schematic view of a digital camera incorporating a display device having a driver according to the present invention, FIG. 17 illustrates the application of the driver circuit of the present invention to a magnetic RAM, and FIG. 18 illustrates an alternative application of the driver circuit of the present invention to a magnetic RAM, and FIG. 19 illustrates the application of the driver circuit of the present invention to a magnetoresistive element.

Figure 1:
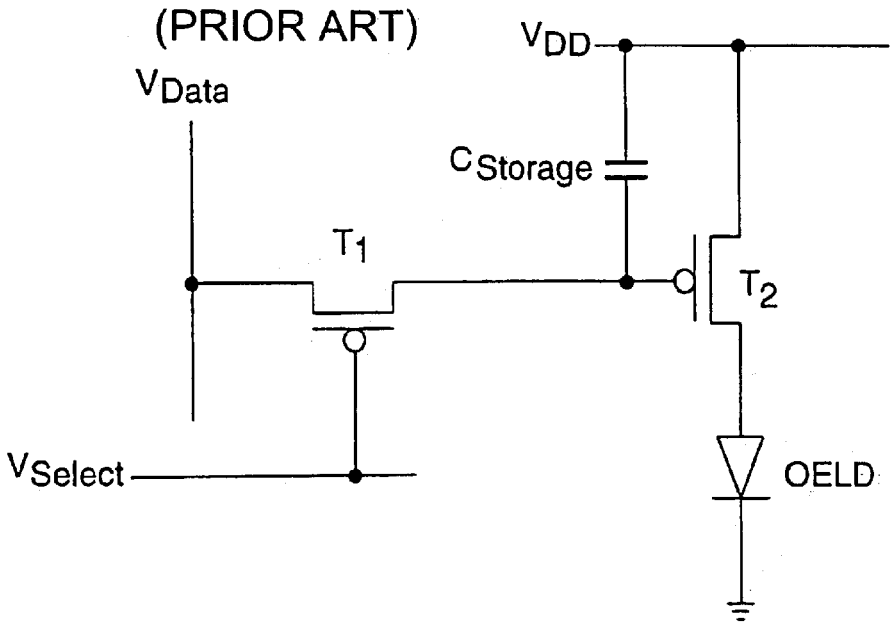
Fig.1 (PRIOR ART)
FIG. 1 shows a conventional OEL element pixel driver circuit using two transistors.
Figure 2:
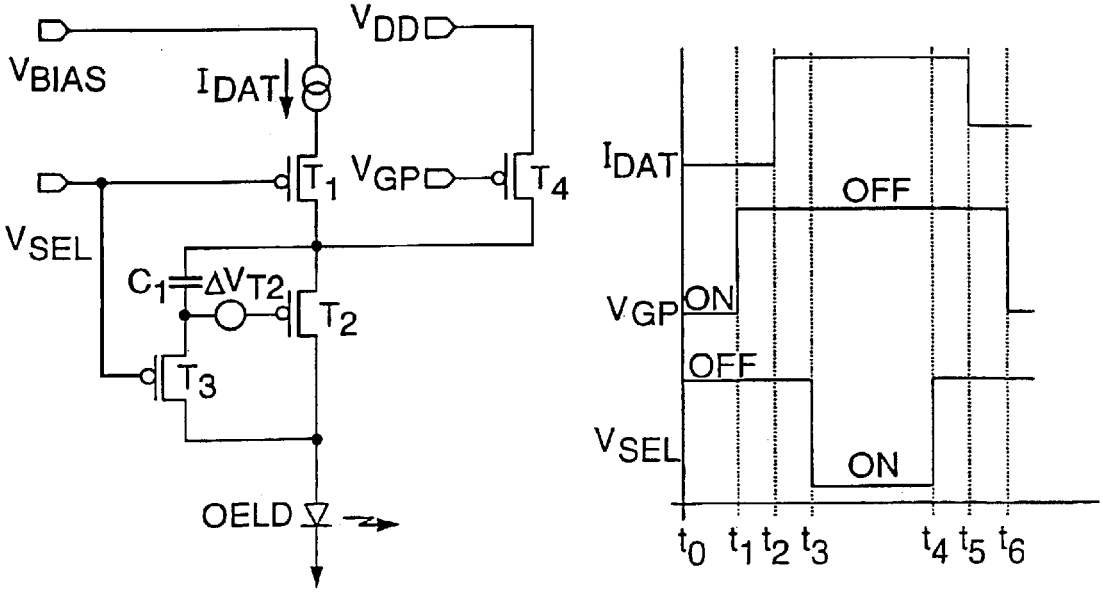
Fig.2 (PRIOR ART)
FIG. 2 shows a known current programmed OEL element driver circuit with threshold voltage compensation.
Figure 3:
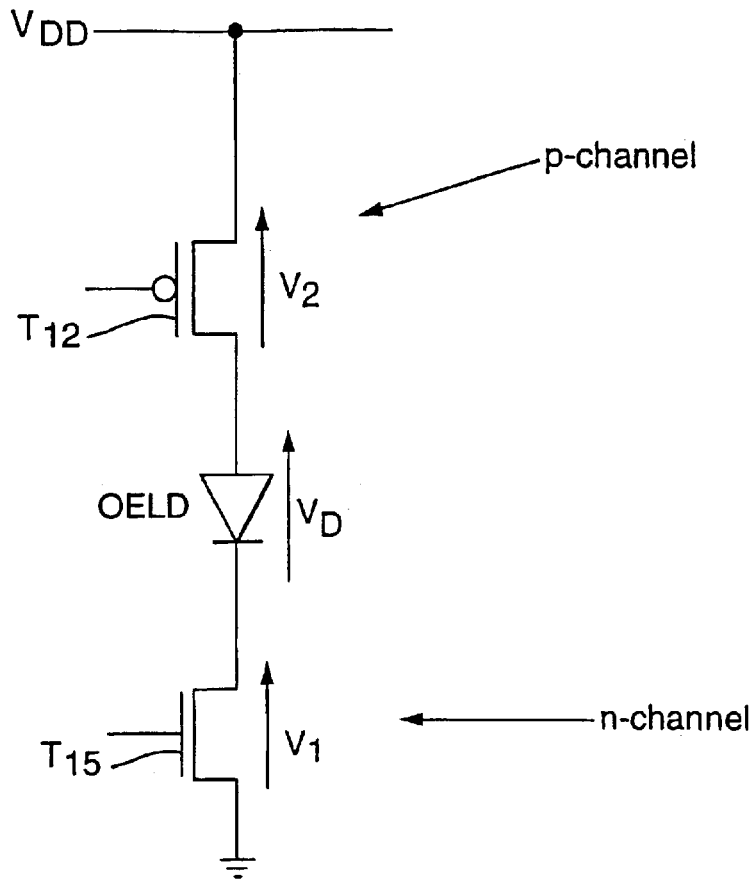
FIG. 3 illustrates the concept of a driver circuit including a complementary pair of driver transistors for providing threshold voltage compensation in accordance with the present invention.

The concept of a driver circuit according to the present invention is illustrated in FIG. 3. An OEL element is coupled between two transistors $T_{12}$ and $T_{15}$ which operate, in combination, as an analog current control for the current flowing through the OEL element. Transistor $T_{12}$ is a p-channel transistor and transistor $T_{15}$ is an n-channel transistor which act therefore, in combination, as a complementary pair for analog control of the current through the OEL element.

As mentioned previously, one of the most important parameters in a TFT analog circuit design is the threshold voltage $V_T$. Any variation, $\Delta V_T$ within a circuit has a significant effect on the overall circuit performance. Variations in the threshold voltage can be viewed as a rigid horizontal shift of the source to drain current versus the gate to source voltage characteristic for the transistor concerned and are caused by the interface charge at the gate of the transistor.

It has been realised with the present invention that in an array of TFT devices, in view of the fabrication techniques employed, neighbouring or relatively close TFT's have a high probability of exhibiting the same or an almost similar value of threshold voltage $\Delta V_T$. Furthermore, it has been realised that as the effects of the same $\Delta V_T$ on p-channel and n-channel TFT's are complementary, compensation for variations in threshold voltage $\Delta V_T$ can be achieved by employing a pair of TFT's, one p-channel TFT and one n-channel TFT, to provide analog control of the driving current flowing to the OEL element. The driving current can, therefore, be provided independently of any variation of the threshold voltage. Such a concept is illustrated in FIG. 3.

Figure 4:
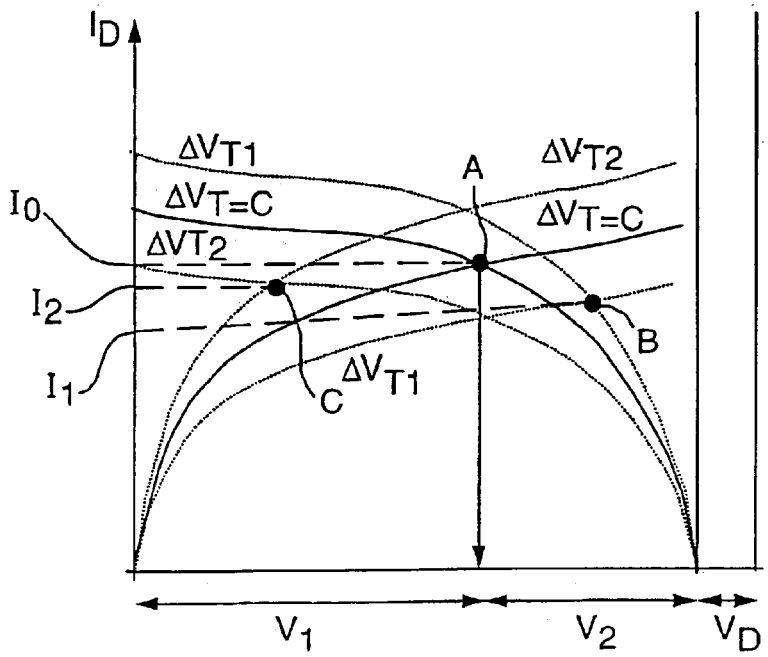
FIG. 4 shows plots of characteristics for the complementary driver transistors illustrated in FIG. 3 for various levels of threshold voltages.

FIG. 4 illustrates the variation in drain current, that is the current flowing through the OEL element shown in FIG. 3, for various levels of threshold voltage $\Delta V_T$, $\Delta V_{T1}$, $\Delta V_{T2}$ for the transistors $T_{12}$ and $T_{15}$. Voltages $V_1$, $V_2$ and $V_D$ are respectively the voltages appearing across transistor $T_{12}$, $T_{15}$ and the OEL element from a voltage source $V_{DD}$. Assuming that the transistors $T_{12}$ and $T_{15}$ have the same threshold voltage and assuming that $\Delta V_T$=O, then the current flowing through the OEL element,is given by cross-over point A for the characteristics for the p-channel transistor $T_{12}$ and the n-channel transistor $T_{15}$ shown in FIG. 4. This is shown by value $I_0$.

Assuming now that the threshold voltage of the p-channel and n-channel transistors changes to $\Delta V_{T1}$, the OEL element current $I_1$ is then determined by crossover point B. Likewise, for a variation in threshold voltage to $\Delta V_2$, the OEL element current $I_2$ is given by crossover point C. It can be seen from FIG. 4 that even with the variations in the threshold voltage there is minimal variation in the current flowing through the OEL element.

Figure 5:
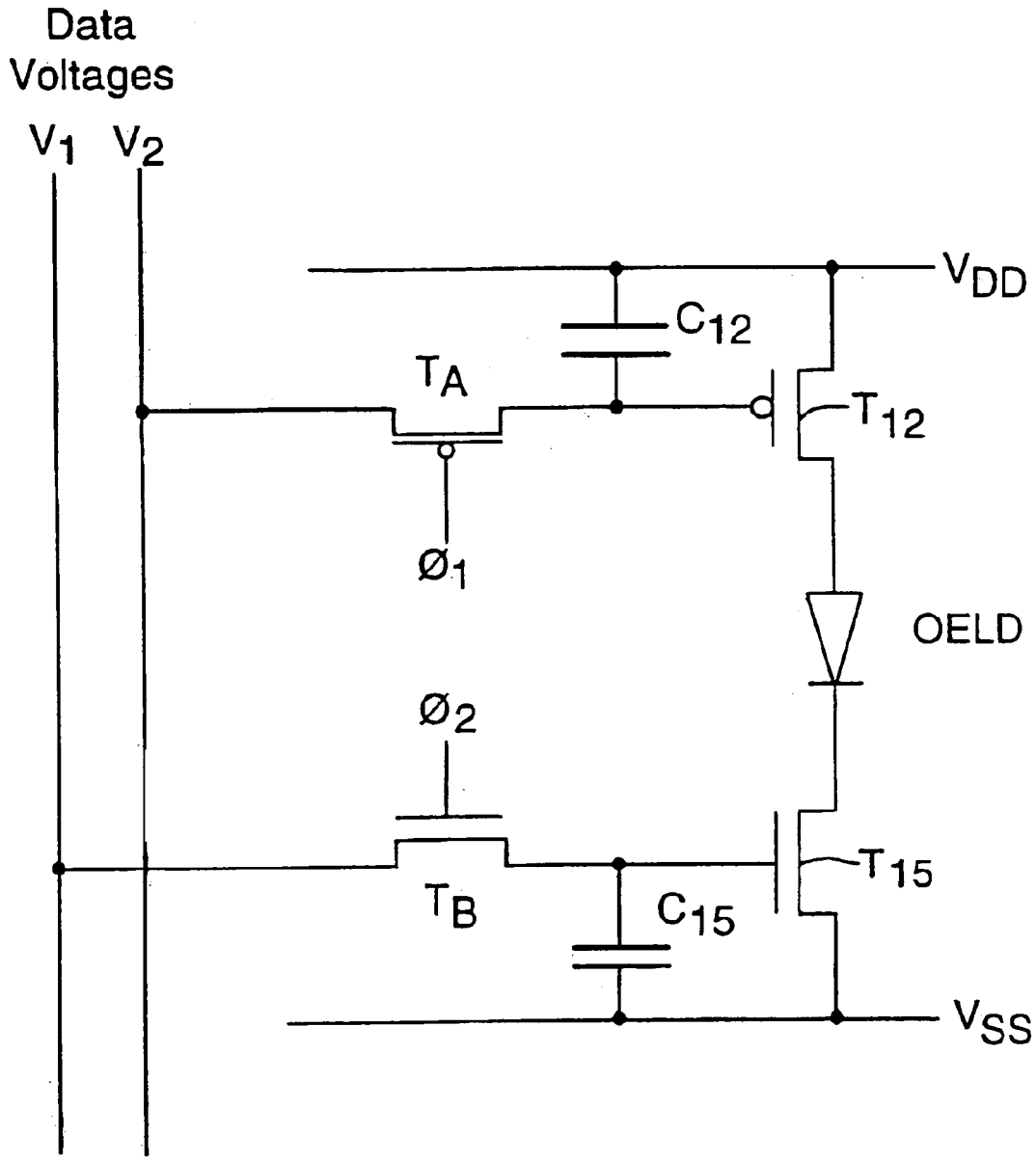
FIG. 5 shows a driver circuit arranged to operate as a voltage driver circuit in accordance with a first embodiment of the present invention.

FIG. 5 shows a pixel driver circuit configured as a voltage driver circuit. The circuit comprises p-channel transistor $T_{12}$ and n-channel transistor $T_{15}$ acting as a complementary pair to provide, in combination, an analog current control for the OEL element. The circuit includes respective storage capacitors $C_{12}$ and $C_{15}$ and respective switching transistors $T_A$ and $T_B$ coupled to the gates of transistors $T_{12}$ and $T_{15}$. When transistors $T_A$ and $T_B$ are switched ON data voltage signals $V_1$ and $V_2$ are stored respectively in storage capacitors $C_{12}$ and $C_{15}$ when the pixel is not addressed. The transistors $T_A$ and $T_B$ function as pass gates under the selective control of addressing signals $\phi_1$ and $\phi_2$ applied to the gates of transistors $T_A$ and $T_B$.

Figure 6:
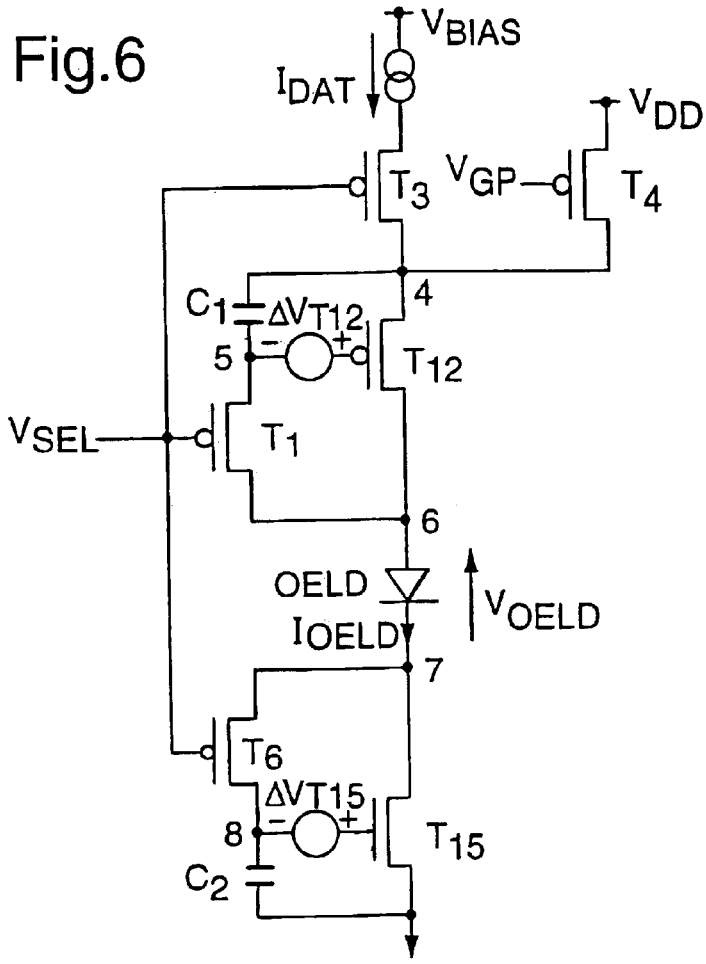
FIG. 6 shows a driver circuit arranged to operate as a current programmed driver circuit in accordance with a second embodiment of the present invention.
Figure 6:
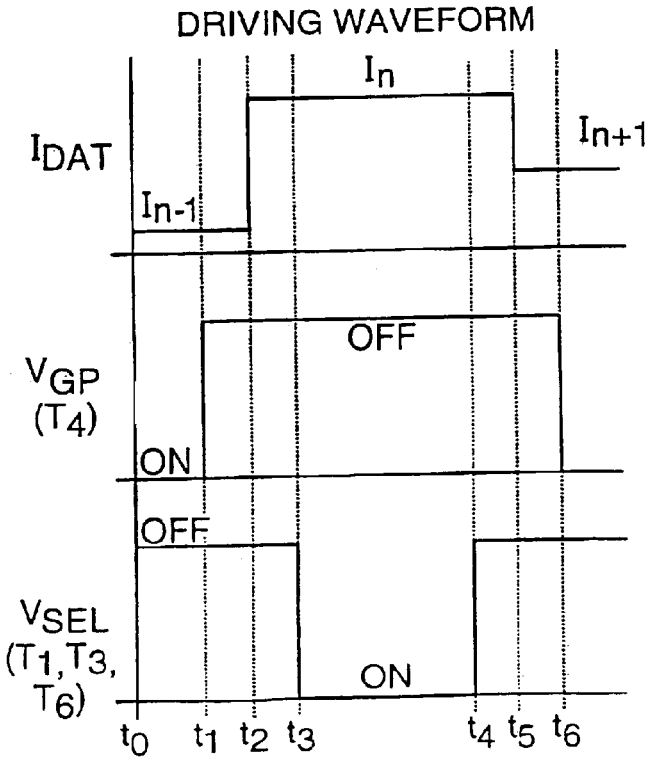

FIG. 6 shows a driver circuit according to the present invention configured as a current programmed OEL element driver circuit. As with the voltage driver circuit, p-channel transistor $T_{12}$ and n-channel transistor $T_{15}$ are coupled so as to function as an analog current control for the OEL element. Respective storage capacitors $C_1$, $C_2$ and respective switching transistors $T_1$ and $T_6$ are provided for transistors $T_{12}$ and $T_{15}$. The driving waveforms for the circuit are also shown in FIG. 6. Either transistors $T_1$, $T_3$ and $T_6$, or transistor $T_4$ can be ON at any one time. Transistors $T_1$ and $T_6$ connect respectively between the drain and gate of transistors $T_{12}$ and $T_{15}$ and switch in response to applied waveform $V_{SEL}$ to toggle transistors $T_{12}$ and $T_{15}$ to act either as diodes or as transistors in saturation mode. Transistor $T_3$ is also connected to receive waveform $V_{SEL}$. Transistors $T_1$ and $T_6$ are both p-channel transistors to ensure that the signals fed through these transistors are at the same magnitude. This is to ensure that any spike currents through the OEL element during transitions of the waveform $V_{SEL}$ are kept to a minimum.

The circuit shown in FIG. 6 operates in a similar manner to known current programmed pixel driver circuits in that a programming stage and a display stage are provided in each display period but with the added benefit that the drive current to the OEL element is controlled by the complementary opposite channel transistors $T_{12}$ and $T_{15}$. Referring to the driving waveforms shown in FIG. 6, a display period for the driver circuit extends from time $t_0$ to time $t_6$. Initially, transistor $T_4$ is ON and transistors $T_1$, $T_3$ and $T_6$ are OFF. Transistor $T_4$ is turned OFF at time $t_1$ by the waveform $V_{GP}$ and transistors $T_1$, $T_3$ and $T_6$ are turned ON at time $t_3$ by the waveform $V_{SEL}$. With transistor $T_1$ and $T_6$ turned ON, the p-channel transistor $T_{12}$ and the complementary n-channel transistor $T_{15}$ act in a first mode as diodes. The driving waveform for the frame period concerned is available from the current source $I_{DAT}$ at time $t_2$ and this is passed by the transistor $T_3$ when it switches on at time $t_3$. The detected threshold voltages of transistors $T_{12}$ and $T_{15}$ are stored in capacitors $C_1$ and $C_2$. These are shown as voltage sources $\Delta V_{T12}$ and $\Delta V_{T15}$ in FIG. 6.

Transistors $T_1$, $T_3$ and $T_6$ are then switched OFF at time $t_4$ and transistor $T_4$ is switched ON at time $t_5$ and the current through the OEL element is then provided from the source VDD under the control of the p-channel and n-channel transistors $T_{12}$ and $T_{15}$ operating in a second mode, i.e. as transistors in saturation mode. It will be appreciated that as the current through the OEL element is controlled by the complementary p-channel and n-channel transistors $T_{12}$ and $T_{15}$ any variation in threshold voltage in one of the transistors will be compensated by the other opposite channel transistor, as described previously with respect to FIG. 4.

Figure 7:
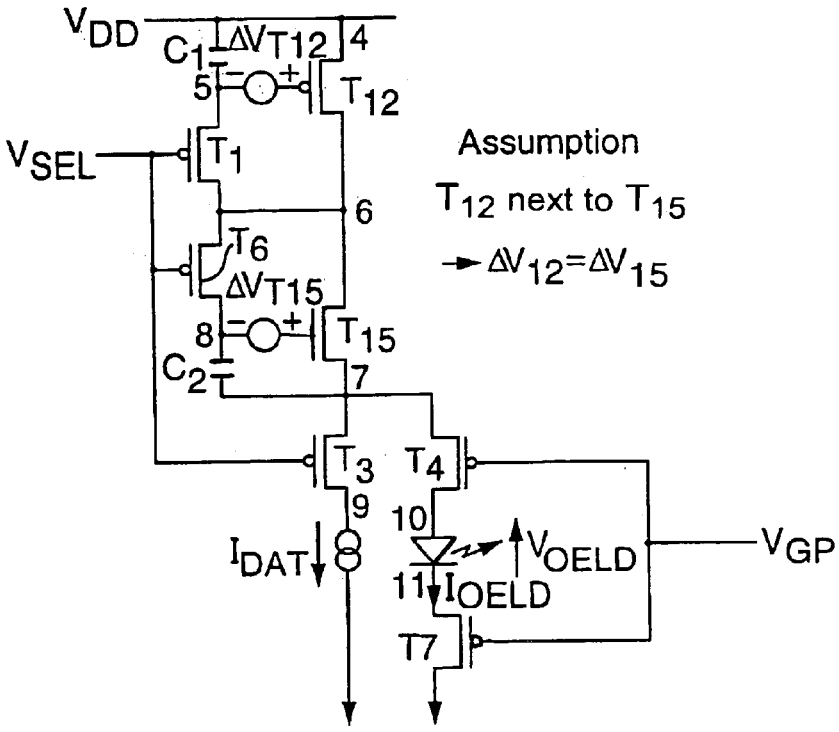
FIG. 7 shows a current programmed driver circuit in accordance with a third embodiment of the present invention.
Figure 7:
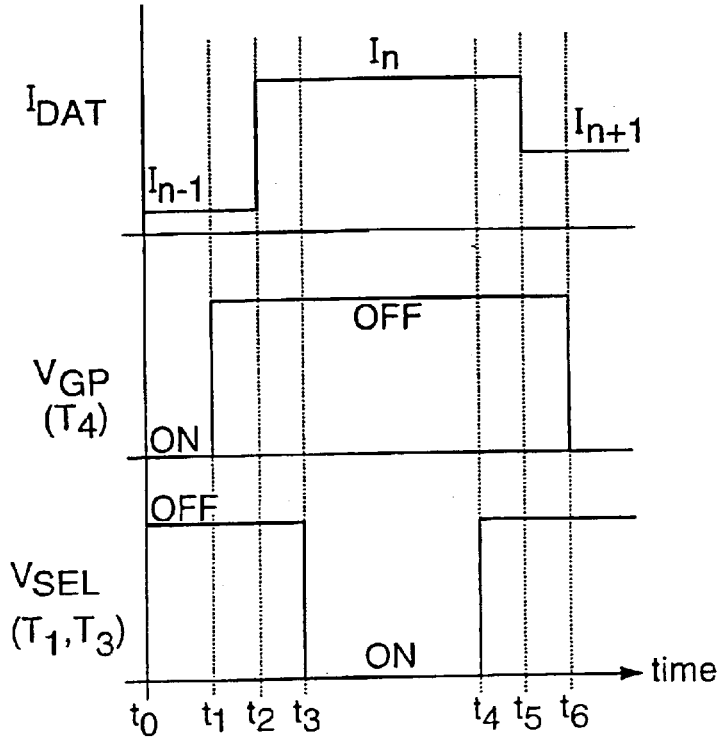

In the current programmed driver circuit shown m FIG. 6, the switching transistor $T_3$ is coupled to the p-channel transistor $T_{12}$, with the source of the driving waveform $I_{DAT}$ operating as a current source. However, the switching transistor $T_3$ may as an alternative be coupled to the n-channel transistor $T_{15}$ as shown in FIG. 7, whereby $I_{DAT}$ operates as a current sink. In all other respects the operation of the circuit shown in FIG. 7 is the same as for the circuit shown in FIG. 6.

FIGS. 8 to 11 show a SPICE simulation of an improved pixel driver circuit according to the present invention.

Figure 8:
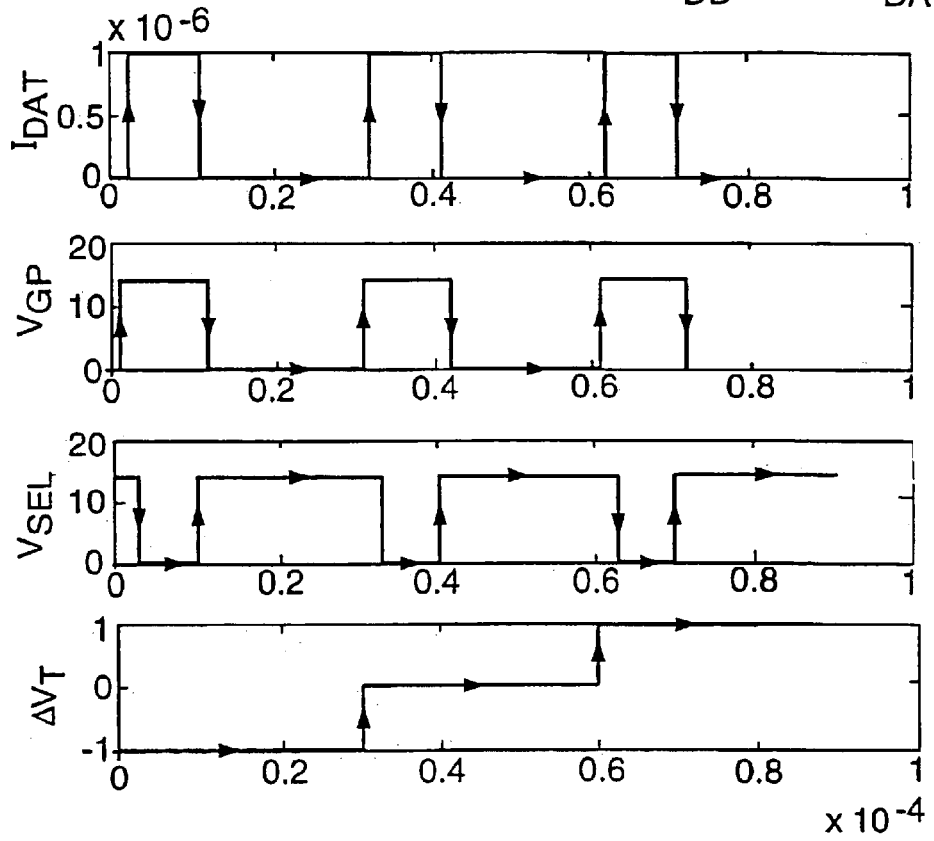
FIGS. 8 to 11 show SPICE simulation results for the circuit illustrated in FIG. 6.

Referring to FIG. 8, this shows the driving waveforms $I_{DAT}$, $V_{GP}$, $V_{SEL}$ and three values of threshold voltage, namely −1 volt, 0 volts and +1 volt used for the purposes of simulation to show the compensating effect provided by the combination of the p-channel and n-channel transistors for controlling the current through the OEL element. From FIG. 8, it can be seen that, initially the threshold voltage $\Delta V_T$ was set at −1 volt, increasing to 0 volts at $0.3\times10^{-4}$ seconds and increasing again to +1 volt at $0.6\times10^{-4}$ seconds. However, it can be seen from FIG. 9 that even with such variations in the threshold voltage the driving current through the OEL element remains relatively unchanged.

Figure 9:
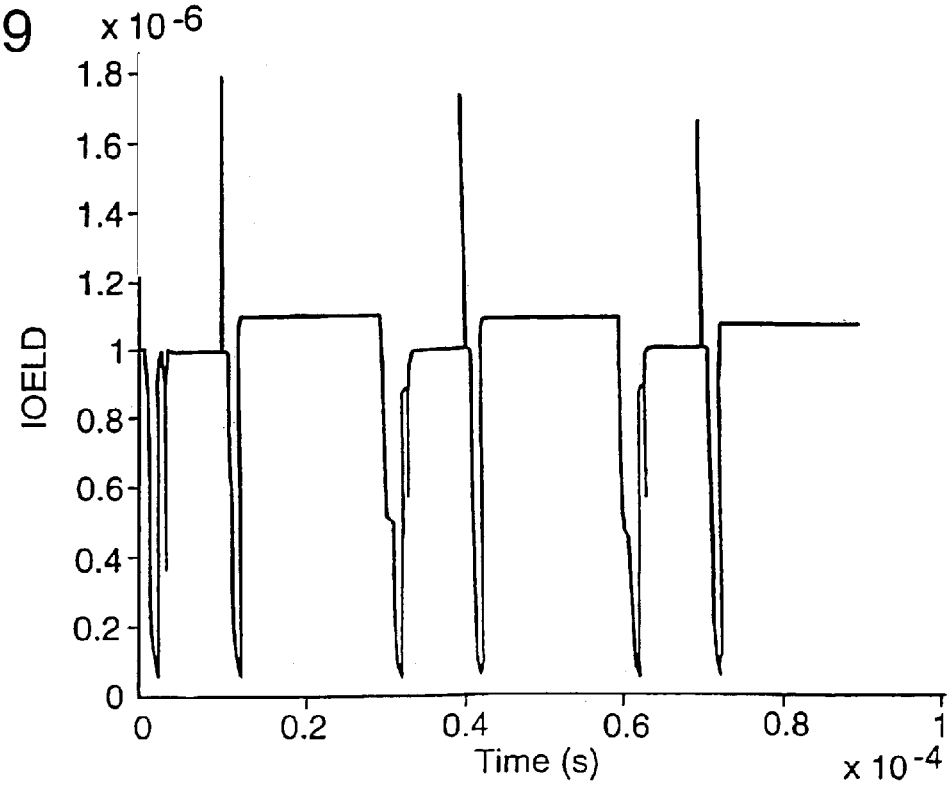
Figure 10:
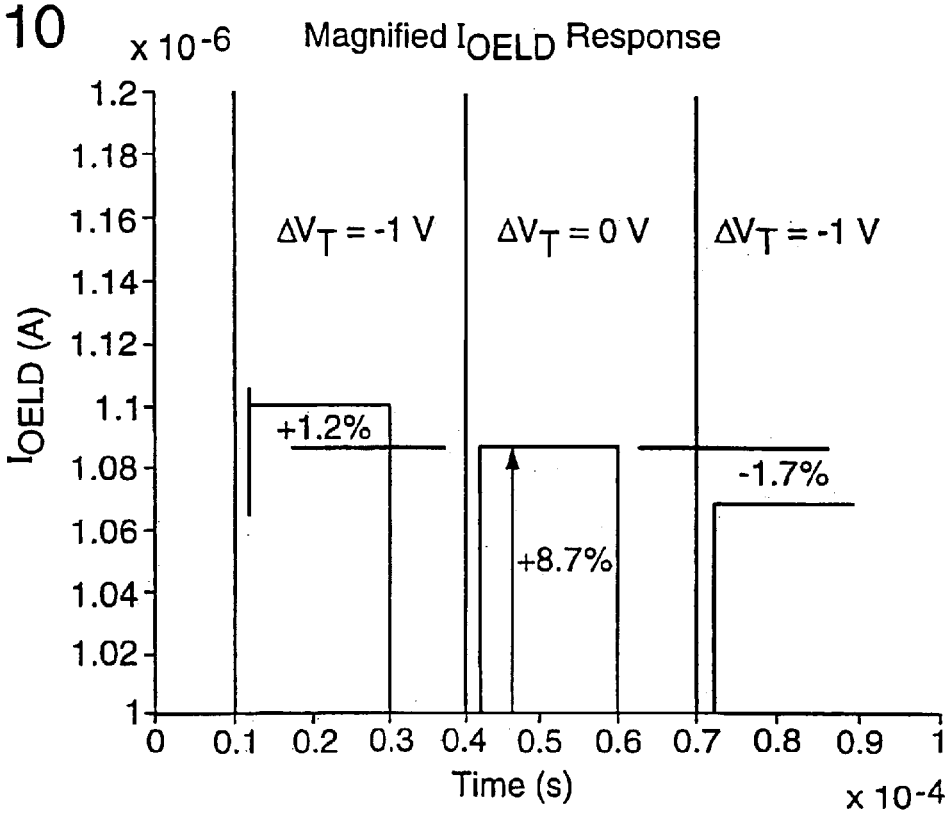

The relative stability in the driving current through the OEL element can be more clearly seen in FIG. 10, which shows a magnified version of the response plots shown in FIG. 9.

It can be seen from FIG. 10 that, using a value of 0 volts as a base for the threshold voltage $\Delta V_T$, that if the threshold voltage $\Delta V_T$ changes to −1 volts there is a change of approximately 1.2% in the drive current through the OEL element and if the threshold voltage $\Delta V_T$ is changed to +1 volt, there is a reduction in drive current of approximately 1.7% compared to the drive current when the threshold voltage $\Delta V_T$ is 0 volts. The variation of drive current of 8.7% is shown for reference purposes only as such a variation can be compensated by gamma correction, which is well known in this art and will not therefore be described in relation to the present invention.

Figure 11:
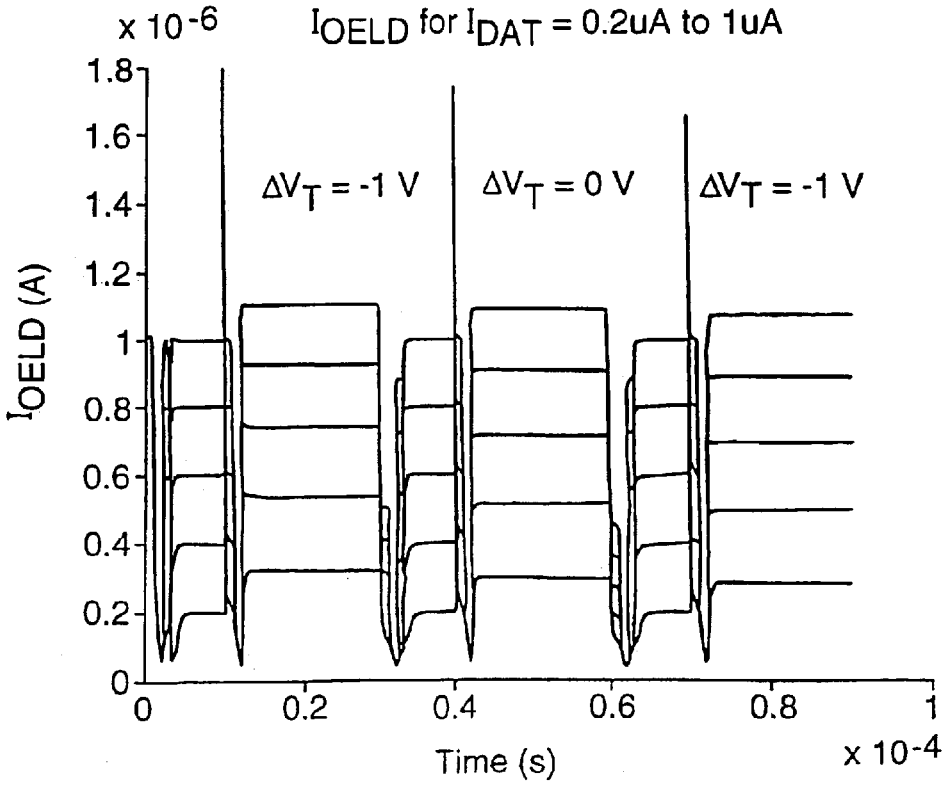

FIG. 11 shows that for levels of $I_{DAT}$ ranging from 0.2 $\mu$A to 1.0 $\mu$A, the improved control of the OEL element drive current is maintained by the use of the p-channel and opposite n-channel transistors in accordance with the present invention.

It will be appreciated from the above description that the use of a p-channel transistor and an opposite n-channel transistor to provide, in combination, analog control of the drive current through an electroluminescent device provides improved compensation for the effects which would otherwise occur with variations in the threshold voltage of a single p-channel or n-channel transistor.

Preferably, the TFT n-channel and p-channel transistors are fabricated as neighbouring or adjacent transistors during the fabrication of an OEL element OEL display so as to maximise the probability of the complementary p-channel and n-channel transistors having the same value of threshold voltage $\Delta V_T$. The p-channel and n-channel transistors may be further matched by comparison of their output characteristics.

FIG. 12 is a schematic cross-sectional view of the physical implementation of the pixel driver circuit in an OEL element structure. In FIG. 12, numeral 132 indicates a hole injection layer, numeral 133 indicates an organic EL layer, and numeral 151 indicates a resist or separating structure. The switching thin-film transistor 121 and the n-channel type current-thin-film transistor 122 adopt the structure and the process ordinarily used for a low-temperature polysilicon thin-film transistor, such as are used for example in known thin-film transistor liquid crystal display devices such as a top-gate structure and a fabrication process wherein the maximum temperature is 600° C. or less. However, other structures and processes are applicable.

The forward oriented organic EL display element 131 is formed by: the pixel electrode 115 formed of A1, the opposite electrode 116 formed of ITO, the hole injection layer 132, and the organic EL layer 133. In the forward oriented organic EL display element 131, the direction of current of the organic EL display device can be set from the opposite electrode 116 formed of ITO to the pixel electrode 115 formed of A1.

The hole injection layer 132 and the organic EL layer 133 maybe formed using an ink-jet printing method, employing the resist 151 as a separating structure between the pixels.

The opposite electrode 116 formed of ITO may be formed using a sputtering method. However, other methods may also be used for forming all of these components.

The typical layout of a full display panel employing the present invention is shown schematically in FIG. 13. The panel comprises an active matrix OEL element 200 with analogue current program pixels, an integrated TFT scanning driver 210 with level shifter, a flexible TAB tape 220, and an external analogue driver LSI 230 with an integrated RAM/controller. Of course, this is only one example of the possible panel arrangements in which the present invention can be used.

The structure of the organic EL display device is not limited to the one described here. Other structures are also applicable.

The improved pixel driver circuit of the present invention may be used in display devices incorporated in many types of equipment such as mobile displays e.g. mobile phones, laptop personal computers, DVD players, cameras, field equipment; portable displays such as desktop computers, CCTV or photo albums; or industrial displays such as control room equipment displays.

Several electric apparatuses using the above organic electroluminescent display device will now be described.

<1: Mobile Computer>

An example in which the display device according to one of the above embodiments is applied to a mobile personal computer will now be described.

FIG. 14 is an isometric view illustrating the configuration of this personal computer. In the drawing, the personal computer 1100 is provided with a body 1104 including a keyboard 1102 and a display unit 1106. The display unit 1106 is implemented using a display panel fabricated according to the present invention, as described above.

<2: Portable Phone>

Next, an example in which the display device is applied to a display section of a portable phone will be described. FIG. 15 is an isometric view illustrating the configuration of the portable phone. In the drawing, the portable phone 1200 is provided with a plurality of operation keys 1202, an earpiece 1204, a mouthpiece 1206, and a display panel 100, This display panel 100 is implemented using a display panel fabricated according to the present invention, as described above.

<3: Digital Still Camera>

Next, a digital still camera using an OEL display device as a finder will be described. FIG. 16 is an isometric view illustrating the configuration of the digital still camera and the connection to external devices in brief.

Typical cameras sensitize films based on optical images from objects, whereas the digital still camera 1300 generates imaging signals from the optical image of an object by photoelectric conversion using, for example, a charge coupled device (CCD). The digital still camera 1300 is provided with an OEL element 100 at the back face of a case 1302 to perform display based on the imaging signals from the CCD. Thus, the display panel 100 functions as a finder for displaying the object A photo acceptance unit 1304 including optical lenses and the CCD is provided at the front side (behind in the drawing) of the case 1302.

When a cameraman determines the object image displayed in the OEL element panel 100 and releases the shutter, the image signals from the CCD are transmitted and stored to memories in a circuit board 1308. In the digital still camera 1300, video signal output terminals 1312 and input/output terminals 1314 for data communication are provided on a side of the case 1302. As shown in the drawing a television monitor 1430 and a personal computer 1440 are connected to the video signal terminals 1312 and the input/output terminals 1314, respectively, if necessary. The imaging signals stored in the memories of the circuit board 1308 are output to the television monitor 1430 and the personal computer 1440, by a given operation.

Examples of electronic apparatuses, other than the personal computer shown in FIG. 14, the portable phone shown in FIG. 15, and the digital still camera shown in FIG. 16, include OEL element television sets, view-finder-type and monitoring-type video tape recorders, car navigation systems, pagers, electronic notebooks, portable calculators, word processors, workstations, TV telephones, point-of-sales system (POS) terminals, and devices provided with touch panels. Of course, the above OEL device can be applied to display sections of these electronic apparatuses.

The driver circuit of the present invention can be disposed not only in a pixel of a display unit but also in a driver disposed outside a display unit.

In the above, the driver circuit of the present invention has been described with reference to various display devices. The applications of the driver circuit of the present invention are much broader than just display devices and include, for example, its use with a magnetoresistive RAM, a capacitance sensor, a charge sensor, a DNA sensor, a night vision camera and many other devices.

FIG. 17 illustrates the application of the driver circuit of the present invention to a magnetic RAM. In FIG. 17 a magnetic head is indicated by the reference MH.

FIG. 18 illustrates an alternative application of the driver circuit of the present invention to a magnetic RAM. In FIG. 18 a magnetic head is indicated by the reference MH.

FIG. 19 illustrates the application of the driver circuit of the present invention to a magnetoresistive element. In FIG. 19 a magnetic head is indicated by the reference MH, and a magnetic resistor is indicated by the reference MR.

The aforegoing description has been given by way of example only and it will be appreciated by a person skilled in the art that modifications can be made without departing from the scope of the present invention.

What is claimed is:

1. A driver circuit, comprising:

a first storage capacitor;

a second storage capacitor;

an n-channel transistor, of which a gate is connected to the first storage capacitor; and a p-channel transistor, of which a gate is connected to the second storage capacitor, a current driven element being disposed between the n-channel transistor and the p-channel transistor, a data current according to a data signal flowing through the p-channel transistor and the n-channel transistor so that a first operating voltage of the n-channel transistor and a second operating voltage of the p-channel transistor are set by the first storage capacitor and the second storage capacitor, and the n-channel transistor and the p-channel transistor operatively controlling, in combination, a driving current according to the data signal supplied to a current driven element.

2. The driver circuit as claimed in claim 1, further comprising first switching means, the first switching means and a source of the data current being connected so as to provide when operative a current source for the current driven element.

3. The driver circuit as claimed in claim 1, further comprising first switching means, the first switching means and a source of the data current being connected so as to provide when operative a current sink for the current driven element.

4. The driver circuit as claimed in claim 1, further comprising a second switching means, the second switching means being connected to bias the n-channel transistor and the p-channel transistor to act as diodes respectively when the data current flows through the n-channel transistor and p-channel transistor.

5. The driver circuit as claimed in claim 1, the n-channel transistor and the p-channel transistor being polysilicon thin film transistors.

6. The driver circuit as claimed in claim 1, the current driven element being an electroluminescent element.

7. The driver circuit as claimed in claim 1, the n-channel transistor and the p-channel transistor being arranged in close proximity to each other.

8. An electro-optical device comprising the driver circuit according to claim 1.

9. An electronic apparatus incorporating an electro-optical device according to claim 8.

10. A driving method of a driver circuit that is for a current driven element and that has an n-channel transistor, a p-channel transistor, the current driven element being disposed between the n-channel transistor and the p-channel transistor, a first storage capacitor connected to a gate of the n-channel transistor, and a second storage capacitor connected to a gate of the p-channel transistor, comprising:

a first step for setting a first operating voltage of the n-channel transistor and a second operating voltage of the p-channel transistor by supplying a data current according to a data signal to the n-channel transistor and the p-channel transistor; and a second step for supplying a current that is controlled by the n-channel transistor and the p-channel transistor in combination to the current driven element.

11. The driving method as claimed in claim 10, in the first step, the n-channel transistor and the p-channel transistor acting as a diode.

12. The driving method as claimed in claim 10, the current driven element being an electroluminescent element.

13. A driver circuit, comprising:

a storage capacitor;

a current driven element;

a driving transistor of which a gate is connected to the storage capacitor, the driving transistor disposed between the current driven element and a voltage source;

an n-channel transistor; and a p-channel transistor, an operating voltage of the driving transistor being set by the storage capacitor by flowing a data current according to a data signal, a driving current that flows through the current driven element flowing through the n-channel transistor, the p-channel transistor and the driving transistor, the driving current flowing from the voltage source to the current driven element, and the current driven element being disposed between the n-channel transistor and the p-channel transistor.

14. The driver circuit according to claim 13, the n-channel transistor and the p-channel transistor being controlled by an identical signal.

15. A driver circuit, comprising:

a first storage capacitor;

a second storage capacitor;

an n-channel transistor of which a gate is connected to the first storage capacitor;

a p-channel transistor of which a gate is connected to the second storage capacitor;

a current driven element disposed between the n-channel transistor and the p-channel transistor;

a first switching transistor connected between a drain of the n-channel transistor and the first storage capacitor; and a second transistor connected between a drain of the p-channel transistor and the second storage capacitor.

16. The driver circuit as claimed in claim 15, the current driven element being an organic electroluminescent element.

17. An electro-optical device comprising the driver circuit according to claim 15.

18. An electronic apparatus incorporating an electro-optical device according to claim 17.

19. A driver circuit, comprising:

a first storage capacitor;

a second storage capacitor;

a first n-channel transistor of which a gate is connected to the first storage capacitor;

a first p-channel transistor of which a gate is connected to the second storage capacitor;

a second n-channel transistor;

a second p-channel transistor;

a current driven element disposed between the second n-channel transistor and the second p-channel transistor;

a first switching transistor connected between a drain of the first n-channel transistor and the first storage capacitor; and a second switching transistor connected between a drain of the first p-channel transistor and the second storage capacitor.

20. The driver circuit according to claim 19, the second n-channel transistor and the second p-channel transistor being controlled by an identical signal.

21. The driver circuit according to claim 19, the first n-channel transistor being connected to the first p-channel transistor.

22. The driver circuit as claimed in claim 19, the current driven element being an organic electroluminescent element.

23. An electro-optical device comprising the driver circuit according to claim 19.

24. An electronic apparatus incorporating an electro-optical device according to claim 23.

25. A driver circuit for driving a current driven element, the driver circuit comprising:

a first transistor;

a second transistor; and a data current according to a data signal determining a first operating voltage of the first transistor and a second operating voltage of the second transistor, the first transistor being an n-channel transistor, the second transistor being a p-channel transistor, and a driving current that is supplied to the current driven element flowing through the first transistor and the second transistor.

26. The driver circuit according to claim 25, further comprising:

a first storage capacitor connected to a first gate of the first transistor; and a second storage capacitor connected to a second gate of the second transistor, the first storage capacitor setting the first operating voltage, and the second storage capacitor setting the second operating voltage.

27. The driver circuit according to claim 26, the first storage capacitor being disposed between a first source and the first gate of the first transistor, and the second storage capacitor being disposed between a second source and the second gate of the second transistor.

28. The driver circuit according to claim 27, further comprising:

a switching device controlling electrical connection between the first source and the first gate and controlling electrical connection between the second source and the second gate.

29. The driver circuit according to claim 25, the current driven element being disposed between the first transistor and the second transistor.

30. The driver circuit according to claim 25, further comprising:

a switching device controlling electrical connection between the current source of the data current and one of the first transistor and the second transistor.

31. The driver circuit according to claim 25, further comprising:

a switching device controlling electrical connection between the current sink of the data current and one of the first transistor and the second transistor.

32. The driver circuit according to claim 25, the first transistor and the second transistor being polysilicon thin film transistors.

33. The driver circuit according to claim 25, the current driven element being an electroluminescent element.

34. The driver circuit according to claim 25, the first transistor and the second transistor being disposed in close proximity to each other.

35. An electro-optical device comprising the driver circuit according to claim 25.

36. The driver circuit according to claim 25, further comprising:

a first switching transistor; and a second switching transistor, the first switching transistor being disposed between a first drain of the first transistor and a first gate of the first transistor, and the second switching transistor being disposed between a second drain of the second transistor and a second date of the second transistor.

37. The driver circuit according to claim 25, further comprising:

a third switching transistor being an n-channel transistor; and a fourth switching transistor being a p-channel transistor, the current driven element being disposed between the third transistor and the fourth transistor, the second switching transistor being disposed between a second drain of the second transistor and a second date of the second transistor.

38. The driver circuit according to claim 37, the third and fourth transistors being controlled by an identical signal.

39. The driver circuit according to claim 38, the first and second transistors being controlled in series.

40. A driving method to drive a driving circuit for a current driven element, the driving method comprising:

setting at least one of a first operating voltage of a first transistor and a second operating voltage of a second transistor according to a data current at a level that corresponds to a data signal; and supplying a driving current to the current driven element through the first transistor and the second transistor, the data current flowing between a data line and a power source line.

41. The driver circuit according to claim 40, in the first step, the first transistor and the second transistor act as diodes.

* * * * *

UNITED STATES PATENT AND TRADEMARK OFFICE

CERTIFICATE OF CORRECTION

PATENT NO. : 6,919,868 B2
DATED : July 19, 2005
INVENTOR(S) : Simon Tam

It is certified that error appears in the above-identified patent and that said Letters Patent is hereby corrected as shown below:

Title page,
Item [30], Foreign Application Priority Data, please change "0016815" to -- 0016815.3 --.

Signed and Sealed this

First Day of November, 2005

JON W. DUDAS
*Director of the United States Patent and Trademark Office*